US007307493B2

(12) United States Patent
Feldman

(10) Patent No.: US 7,307,493 B2
(45) Date of Patent: Dec. 11, 2007

(54) BROADBAND 180° DEGREE HYBRID MICROWAVE PLANAR TRANSFORMER

(75) Inventor: Alexander Feldman, San Jose, CA (US)

(73) Assignee: Anritsu Company, Morgan Hill, CA (US)

( * ) Notice: Subject to any disclaimer, the term of this patent is extended or adjusted under 35 U.S.C. 154(b) by 209 days.

(21) Appl. No.: 11/261,690

(22) Filed: Oct. 28, 2005

(65) Prior Publication Data

US 2006/0091974 A1 May 4, 2006

Related U.S. Application Data

(60) Provisional application No. 60/623,287, filed on Oct. 29, 2004.

(51) Int. Cl.
*H01P 5/12* (2006.01)
*H01P 3/02* (2006.01)

(52) U.S. Cl. ..... 333/117; 333/100

(58) Field of Classification Search ..... 333/117, 333/118, 119, 25, 26, 100
See application file for complete search history.

(56) References Cited

U.S. PATENT DOCUMENTS 5,125,111 A * 6/1992 Trinh ..... 455/327
5,821,815 A * 10/1998 Mohwinkel ..... 330/286

* cited by examiner

*Primary Examiner*—Dean Takaoka
(74) *Attorney, Agent, or Firm*—Fliesler Meyer LLP

(57) ABSTRACT

A hybrid 180° microwave balun device is provided to convert an unbalanced RF signal at the common port into two radio frequency signals with equal amplitude and 180° phase difference at two differential ports. The hybrid device includes a coplanar waveguide connecting to the common port. A power divider separates the coplanar waveguide into two symmetrical slotline waveguides to carry balanced signals. Two broadband multioctave slotline to microstrip transitions constructed in a way that the microstrip lines carry 180° phase separated signals to the differential output ports.

18 Claims, 9 Drawing Sheets

BROADBAND 180° DEGREE HYBRID MICROWAVE PLANAR TRANSFORMER

CROSS-REFERENCE TO PROVISIONAL APPLICATION

This Patent Application claims the benefit of Provisional Application No. 60/623,287 filed Oct. 29, 2004.

BACKGROUND

1. Technical Field

The present invention relates to the field of microwave and RF electronics, and more particularly to broadband hybrid structures.

2. Related Art

A 180° hybrid is a component that provides a phase-shifted output of unbalanced RF signals. The 180° hybrid is an essential component for a multi-port vector network analyzer (VNA) that offers true differential measurement capability. Differential measurements are becoming more important due to greater use of differential components and circuits in the modern communications industry.

In order to provide a phase-shifted output, an unbalanced signal must be converted into two balanced signals that are later converted into two unbalanced output signals with equal amplitude and 180° phase shift. To create two balanced signals, a balun is typically employed. A balun is an electronic circuit component that converts an unbalanced Radio Frequency (RF) signal at an input port into a balanced RF signal at an output port. In essence a balun is an unbalanced to balanced transformer.

A balun-transformer can be implemented using a number of prior art 180° hybrid structures. A low frequency implementation can be achieved with the use of lumped components with constant reactance. The frequency range of application for this type of balun was recently extended into low-gigahertz frequencies.

Coaxial-line balun transformers have good power handling, but limited bandwidth. These devices are relatively large. As the frequency of application increases, it becomes more difficult to connect the quarter-wave sections in the coaxial-line balun circuit without introducing significant discontinuities that degrade the balun performance. The bandwidth of the best coaxial-line baluns was extended into much lower frequencies by introducing ferrite cores mounted along the outer conductor of a coaxial line. The ferrite cores present a high impedance for the common mode currents along the outer conductors of the balun sections, which corresponds to a good input to output isolation at much lower frequencies.

Due to the growing demand for ultra-broadband balanced circuits and systems in the optical communications and test and measurement industries, there is a growing demand for very broadband 180° hybrid structures that would cover frequencies from well below 1 GHz up to 40 GHz. It would be desirable to provide a single 180° hybrid structure that could operate over this entire bandwidth.

SUMMARY

According to embodiments of the present invention a hybrid electronic component (planar hybrid transformer, or differential balun) is provided that converts an unbalanced radio frequency signal at the common port into two radio frequency signals with equal amplitude and 180° phase difference at two differential ports.

The hybrid includes a coplanar waveguide at the common port. A power divider connects the coplanar waveguide to two symmetrical slot lines. In one embodiment, the slotlines are tapered from a wider slot (larger impedance) to a more narrow slot (lower impedance) toward a slotline to microstrip transition to provide a desired impedance matching. The hybrid provides transitions from the two broadband slotlines to microstrip lines in such a matter that the output RF signals have a 180° phase shift with respect to each other. The microstrip lines are formed on the substrate opposite the metalization regions wherein the slotlines are provided.

Each slotline to microstrip transition includes a loop of the slotline around a ground via connecting the microstrip to the metalization region where the slotline is formed. The slotline to microstrip transitions are done in such a manner that one of the microstrip lines is terminated to the metallization region connected to a central conductor of the input coplanar waveguide and the other microstrip line is terminated to the metallization region connected the coplanar ground plane strips. The grounding in different regions causes the 180° phase difference at two differential ports. The slotlines are terminated after the microstrip to slotline transition in a geometric opening structure formed in the metalization on the substrate to provide an open circuit. In one embodiment, the geometric structure is covered with a magnetic material.

In one alternative, one of the differential slotlines provided from the power divider is terminated in a large geometric structure without transition to a microstrip line. The large geometric structure is filled in with a thin film resistive material to form a termination. The second slotline is then provided directly as an output to a balanced port of the hybrid device.

BRIEF DESCRIPTION OF THE DRAWINGS

Further details of the present invention are explained with the help of the attached drawings in which.

DETAILED DESCRIPTION

Figure 1:
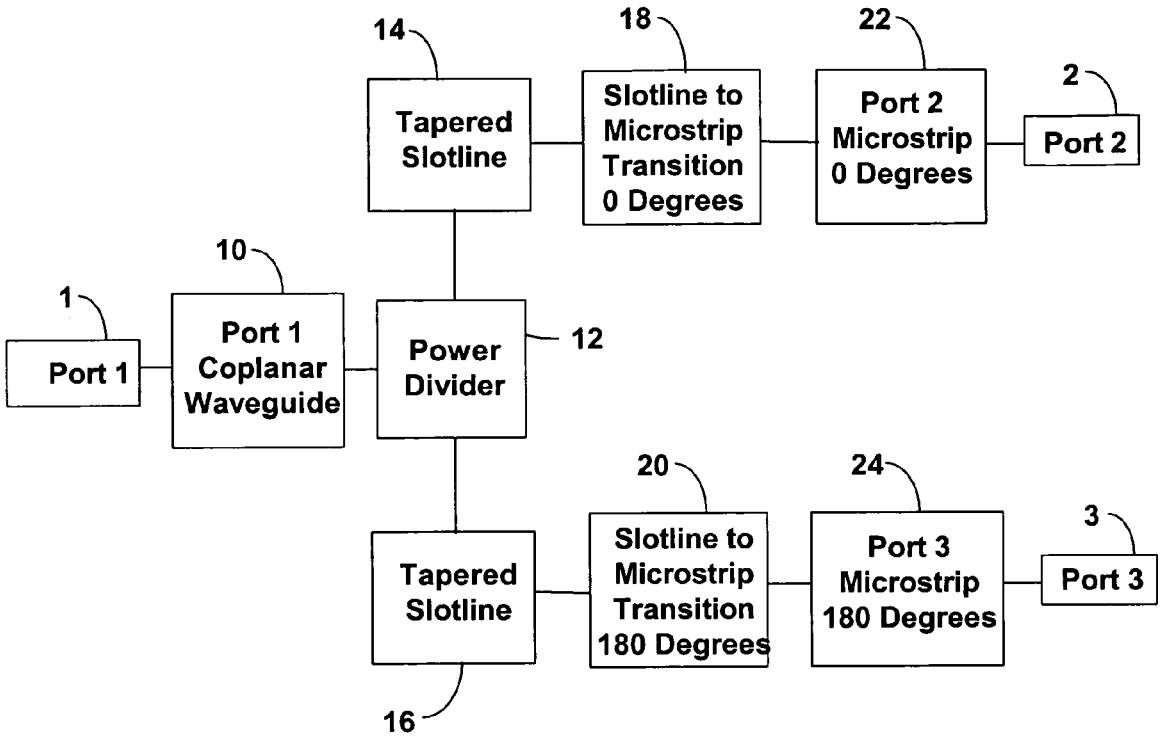
FIG. 1 is a block diagram illustrating a 180° hybrid component according to the present invention.

FIG. 1 is a block diagram illustrating an embodiment of a 180° hybrid component according to the present invention. The hybrid includes a common port 1 and differential ports 2 and 3. The common port 1 connects to coplanar waveguide 10. The coplanar waveguide 10 leads to a power divider 12. In one embodiment, the impedance of the coplanar waveguide 10 is set at 50 Ohms. The power divider 12 in one embodiment transitions the 50 Ohms from the coplanar waveguide 10 to an impedance of 100 Ohms. The outputs of the power divider 12 are connected to two slotlines 14 and 16. In one embodiment, the slotlines 14 and 16 are tapered to transition the 100 Ohm impedance from the power divider 12 down to 50 Ohms. The slotlines 14 and 16 pass the signal to slotline to microstrip transitions 18 and 20. The slotline to microstrip transition passes the signal to two microstrip lines 22 and 24.

Figure 4:
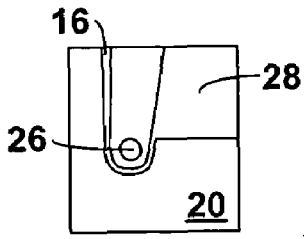
FIG. 4 illustrates details of the microstrip to slotline transition of FIG. 2.

The two microstrip lines 22 and 24 feed into the differential ports 2 and 4. The two microstrip lines 22 and 24 are each terminated (by a connection as illustrated in FIG. 4) into oppositely polarized metalized areas (metalization where the slotlines 14 and 16 are formed) by the slotline to microstrip transitions 18 and 20, thus producing a phase difference of 180° . The microstrip line 22 which feeds port 2 is terminated in the metalized area that has the same polarity as the ground plane conductor of the input coplanar waveguide 10. The microstrip line 24 which feeds port 3 is terminated into the metalized area that has the same polarity as the central conductor of the coplanar waveguide 10.

Figure 2:
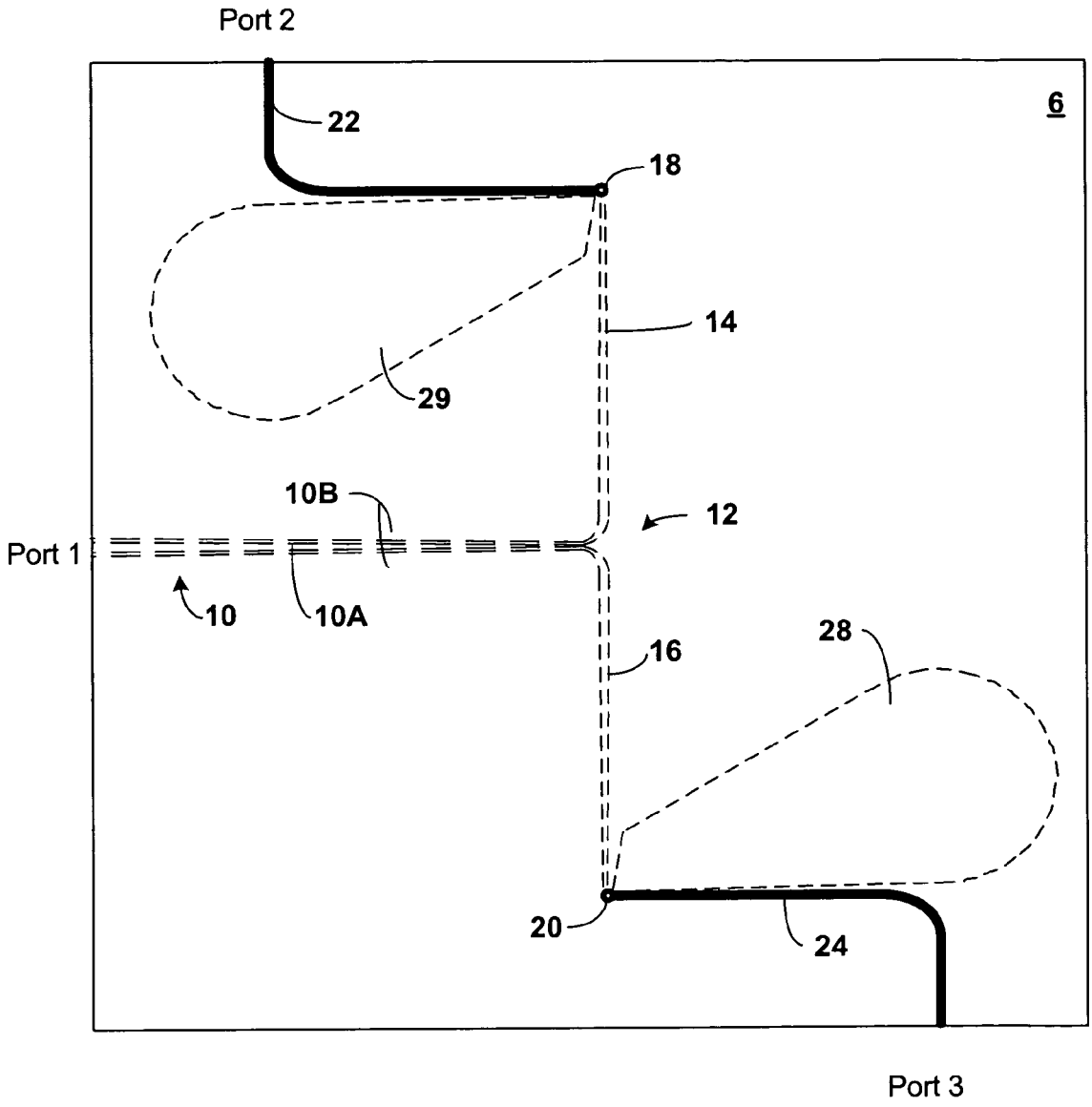
FIG. 2 shows a top view of an embodiment of the 180° hybrid component in accordance with the present invention.

FIG. 2 shows a top view of an embodiment of the 180° hybrid component in accordance with the present invention. Etching on both sides of a substrate 6 making up the 180° hybrid device is shown. The solid lines represent the microstrip transmission lines connected to the differential ports 2 and 3 formed on a first side of the substrate 6. The dashed lines represent components formed on an opposing side of the substrate 6 including: coplanar waveguide 10 (made up of center conductor 10A and outer conductor 10B) connected to port 1, power divider 12, slotlines 14 and 16 extending from power divider 12, two slotline open circuit terminations 28 and 29 and two slotline to microstrip transitions 18 and 20.

Figure 3:
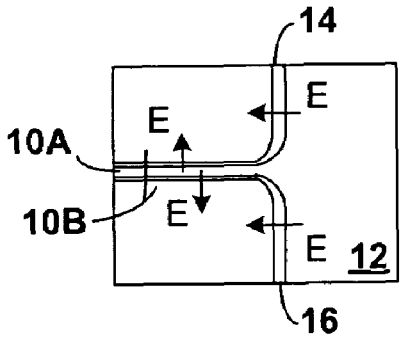
FIG. 3 illustrates the instantaneous electric (E) field polarities of signals carried at terminals of the power divider shown in FIG. 2.

FIG. 3 illustrates the instantaneous electric (E) field polarities of signals carried at the coplanar waveguide and at the terminals of the power divider 12. The slotline 16 that feeds port 3 is terminated by the open circuit 28 in a metalized area of substrate 6. The microstrip line 24 is terminated into the metal strip connected to the center conductor 10A. The ground plane for microstrip line 24 is electrically isolated from the metalized area connected to conductor 10A with a large size open termination 28 which establishes the phase component for the RF signal at Port 3 The microstrip line that feeds port 2 is terminated in the metalized area that has the same polarity as the ground plane conductor of the coplanar line 10 (10B). The ground plane for microstrip line 22 is electrically isolated from the metalized area connected to the conductor 10B of coplanar waveguide 10 by a large size slotline open termination 29 which establishes the phase component for the RF signal at port 2. This way the phase shift between the signals at port 2 and port 3 is maintained at 180° over an extremely wide frequency range.

FIG. 4 illustrates details of the microstrip to slotline transition 20. The physical connection from the microstrip 24 to the metallization area at one side of slot 16 is made using a via 26 through the hybrid substrate 6. The energy carried in each of slotlines 14 and 16 is coupled to the metalized pad in the microstrip lines 22 and 24 through the substrate 6 by the vias, such as 26. To improve the transition, in one embodiment, the slotlines 14 and 16 make a 270° turn, or "spiral" under the microstrip pad around the corresponding via holes and then is abruptly terminated with an open circuit regions 28 and 29.

Figure 5:
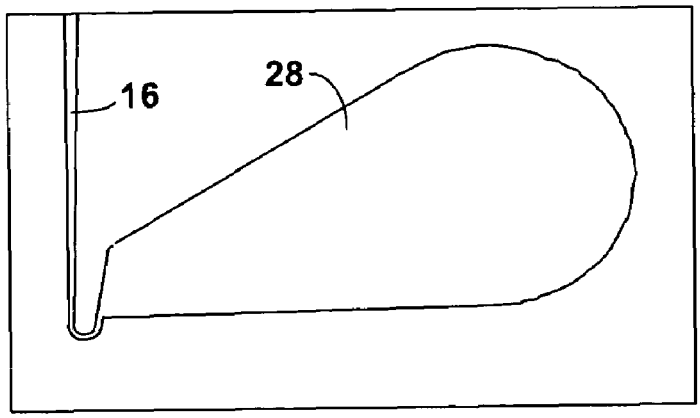
FIG. 5 illustrates details of the open circuit termination region connected to the slotline in FIG. 2.

FIG. 5 shows details of the slotline 16 as connected to an open circuit region 28. The frequency bandwidth of the 180° hybrid structure is greatly expanded at frequencies below 3 GHz by optimizing the shape, size and position of the slotline open circuits 28 and 29. In some embodiments, the optimization of the slotline-to-microstrip transitions 18 and 20, including the slotline open circuits 28 and 29 and the remainder of the 180° hybrid structure can be performed through the use of commercially available high accuracy 3-D high frequency structure simulator software. In one embodiment a 180° hybrid can be fabricated on a 0.01 inch thick substrate.

For the substrate of FIG. 2, the metalization layer in which the slotlines 14 and 16 are formed can be gold, copper, silver or a other desired conductive material. The metallization is etched away to form the coplanar waveguide structure 10, power divider 12, slotline structures 14 and 16 and slotline open terminations 28 and 29.

In some embodiments, impedance transformation is used in one or both of the coplanar waveguide 10 and the slotlines 14 and 16. The characteristic impedance of the balanced slotlines 14 and 16 are gradually transformed from 100 Ohms at the power divider 12 to 50 Ohms at slotline to microstrip transitions 18 and 20 by gradually reducing the width of both slots along the length of the slotlines 14 and 16. The coplanar waveguide 10 is likewise shown gradually transitioned from the unbalanced port 1 gradually toward the power divider 12. The impedance transformation in the power divider 12 with an unbalanced-to-balanced transformer can be accomplished by using a gradual taper in the width of metal conductors and in the width of the slots. In some embodiments a 50 Ohm coplanar structure is transformed into two 100 Ohm slotline structures. In other embodiments, the characteristic impedance of the balanced slotline structures is gradually transformed from 100 Ohms to 50 Ohms.

Figure 6:
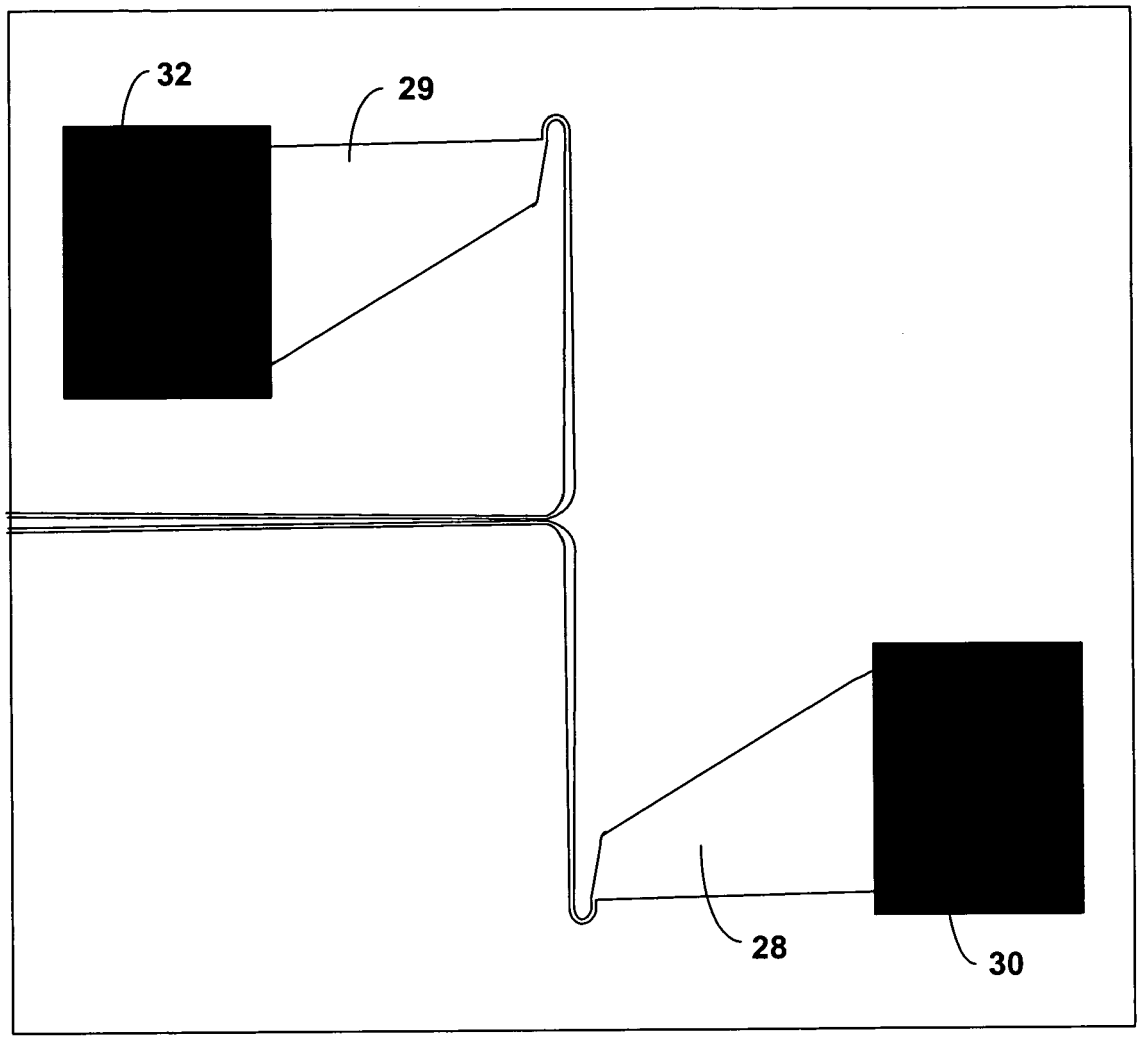
FIG. 6 illustrates an alternate substrate for the 180° hybrid component wherein magnetic material is applied over the slotline terminations.

FIG. 6 illustrates an alternate substrate for the 180° hybrid component wherein magnetic material 30 and 32 is applied over the slotline terminations 28 and 29. The particular type of magnetic material used to form regions 30 and 32 depends on the application requirements. Polyiron mix or a variety of ferrite materials may be applied according to the bandwidth requirements. The shape of the regions 30 and 32 and the extent of coverage over the termination regions 28 and 29 can be selected according to design requirements.

Figure 7:
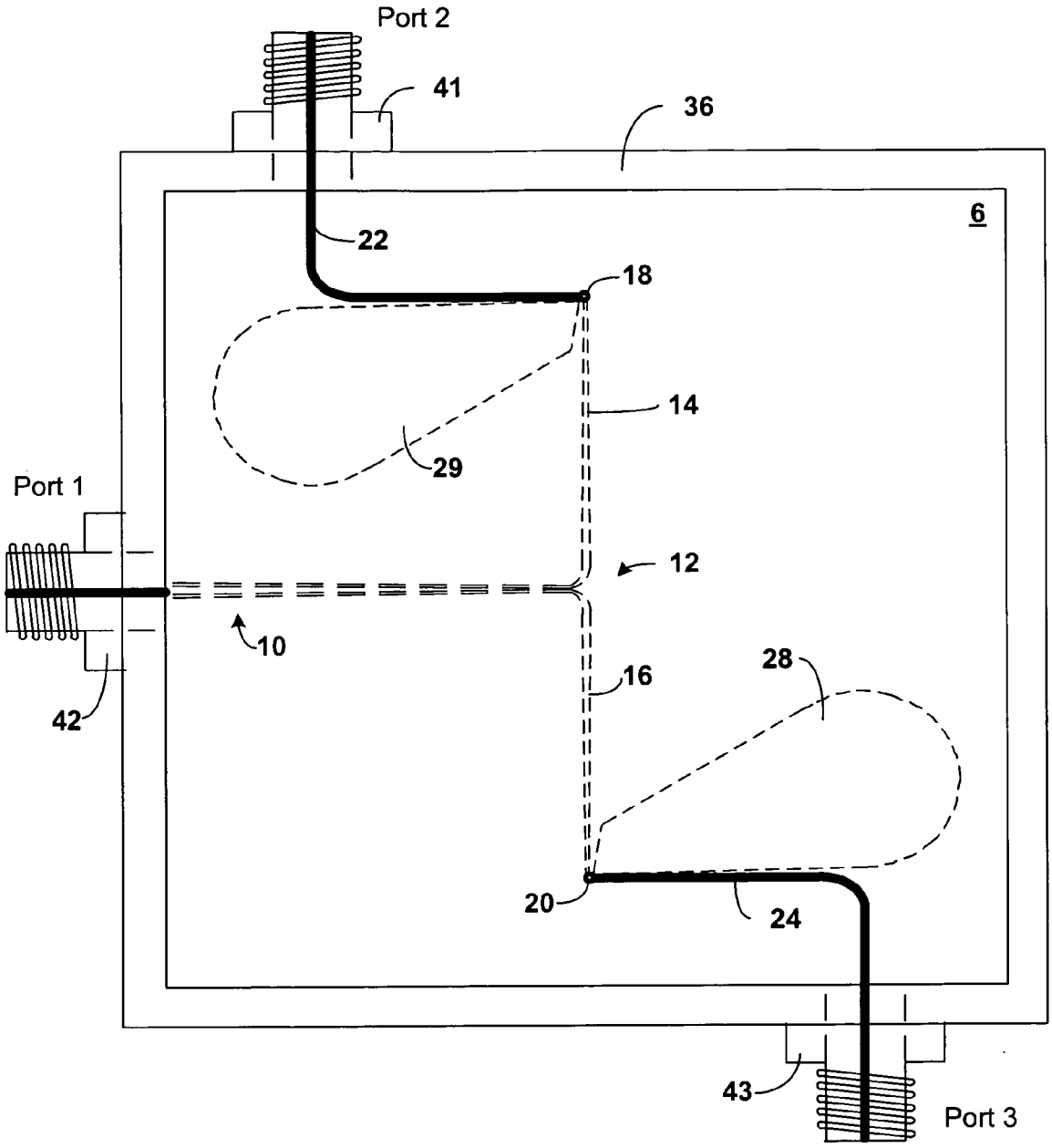
FIG. 7 illustrates the substrate of FIG. 2 as provided in a support fixture with connectors.

FIG. 7 illustrates the substrate 6 for the 180° hybrid component of FIG. 2 as provided in a support fixture 36 with connectors 41-43. The displayed hybrid component 6 of FIG. 2 is presented only for illustrative purposes. It should be clear to those of ordinary skill in the art that any number of physical designs could be used. Components carried over from FIG. 2 are similarly labeled in FIG. 7, as are components carried over in other figures.

Figure 8:
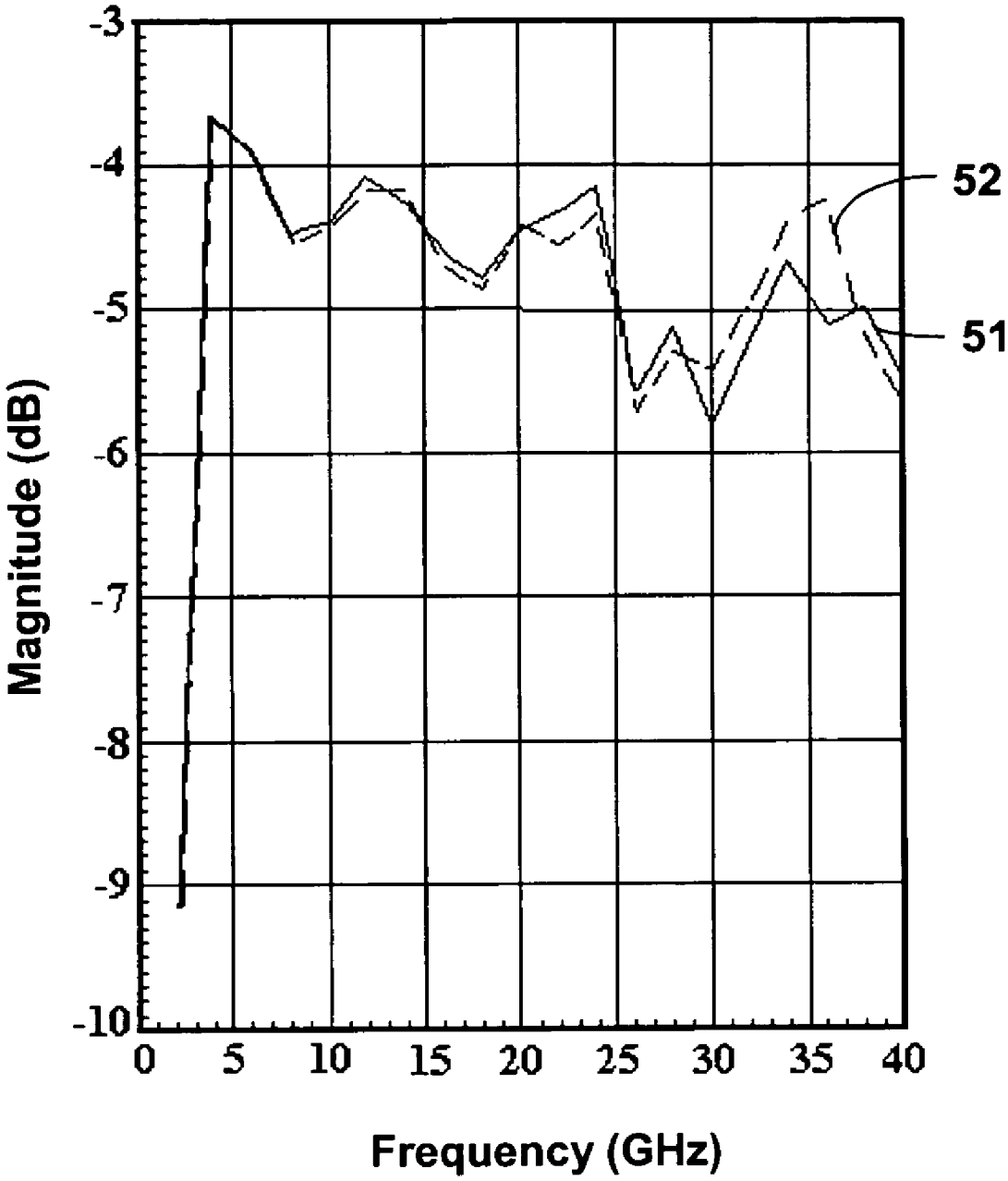
FIG. 8 shows simulation results for $S_{12}$ and $S_{13}$ measurements through a 180° hybrid device having components as shown in FIG. 2.
Figure 9:
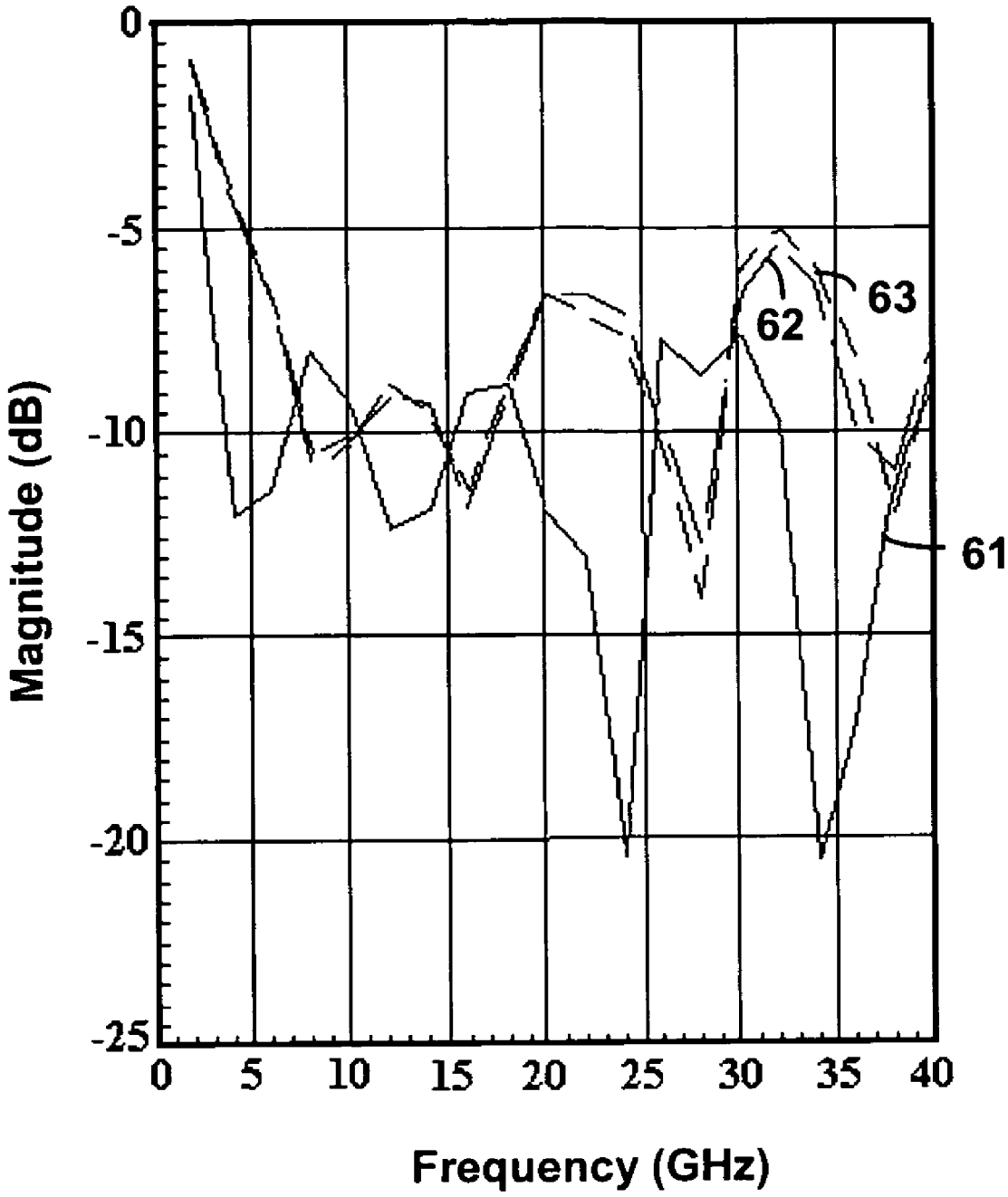
FIG. 9 shows simulation results for $S_{11}$, $S_{22}$ and $S_{33}$ measurements through a 180° hybrid device having components as shown in FIG. 2.
Figure 10:
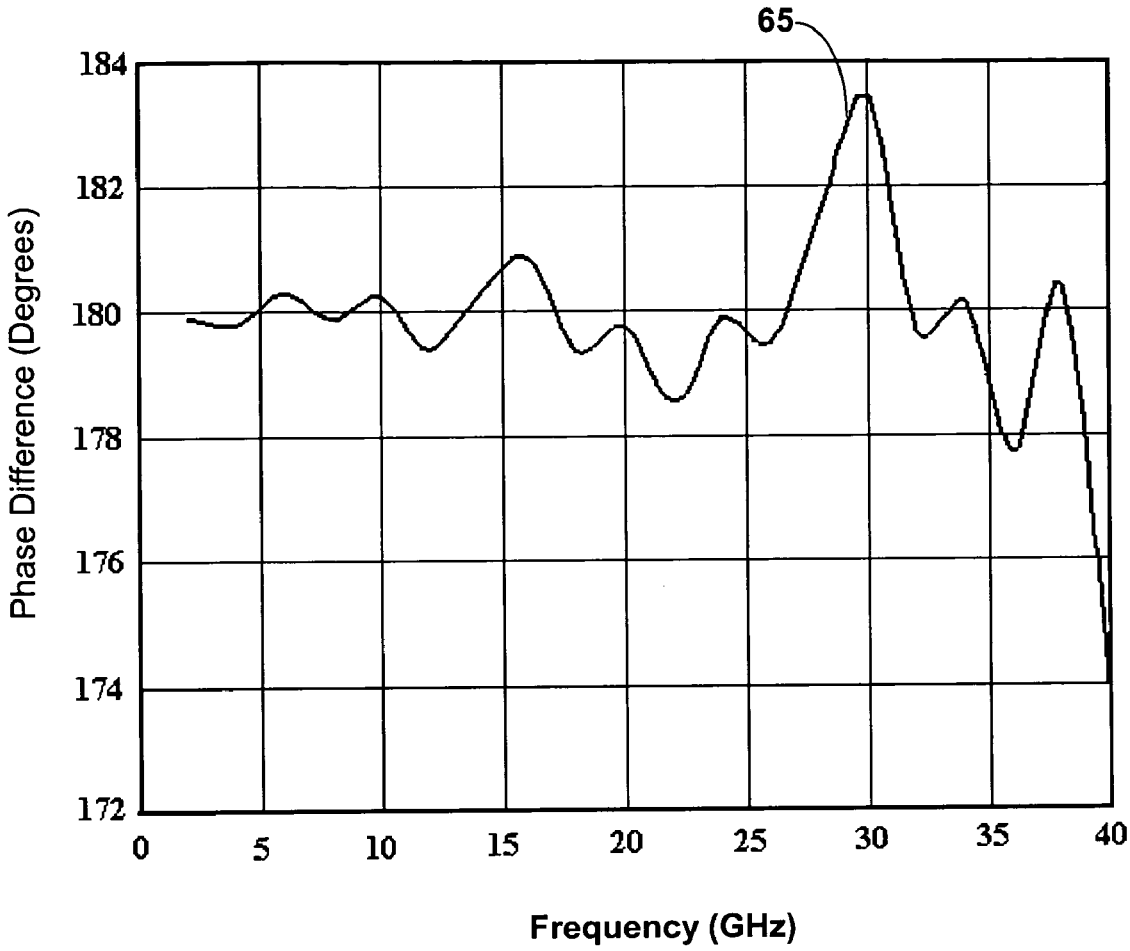
FIG. 10 shows simulation results for phase difference measurements between $S_{12}$ and $S_{13}$ measurements made through a 180° hybrid device having components as shown in FIG. 2.

FIGS. 8-10 illustrates simulation results for measurements from a 180° hybrid component in accordance with one embodiment of the present invention using components as illustrated in FIG. 2. In FIGS. 8-9, the magnitude vs. frequency plots are shown, while FIG. 10 provides a phase difference between port 2 and port 3 signals vs. frequency plot.

FIG. 8 provides S-parameters with transmission coefficient measurements $S_{12}$ (51) and $S_{13}$ (52) superimposed. The measurement for $S_{12}$ (51) is shown with a solid line, while $S_{13}$ (52) is shown with a dashed line. For the measurement $S_{12}$, a signal is applied at port 1 and then measured at port 2, while for $S_{13}$ the signal is applied at port 1 and results measured at port 3. The magnitude is plotted in 1 dB per division from −3 dB to −10 dB, while frequency ranges from 0-40 GHz. As shown, both the plots $S_{12}$ and $S_{13}$ remain between −3.5 dB and −5.5 dB from 3 to 40 GHz. In some embodiments the frequency range of application was extended down to 900 MHz FIG. 9 provides S-parameters with reflection coefficient measurements $S_{11}$ (61) and $S_{22}$ (62) and $S_{33}$ (63) superimposed. The reflection measurements are made by applying a signal to a port and measuring results from the same port. The measurement for $S_{11}$ (61) is shown with a solid line, while $S_{22}$ (62) is a dashed line with long dashes and $S_{33}$ (63) is a dashed line with short dashes. The magnitude is plotted in 5 dB per division from 0 dB to −25 dB, while frequency ranges from 0-40 GHz. As shown, reflection coefficients remain below −5 dB from 0-40 GHz for all of the reflection measurements $S_{11}$, $S_{22}$ and $S_{33}$.

The phase plot demonstrates the phase difference between port 2 and port 3 differential output signals.

FIG. 10 illustrates the simulation result plot 65 showing the phase difference for the signals $S_{21}$ and $S_{31}$. For the frequency range of 0-25 GHz, the phase difference remains within two degrees of 180 degrees. From 0-40 GHz, the phase difference remains within four degrees of 180 degrees.

Referring to FIGS. 8-10, it has been determined that as the frequency of the signal decreases there is a certain ratio of the diameter of open circuit circular termination 28 and 29 to the length of the slotline at which the slotline mode becomes the non-dominant mode for the propagation of electromagnetic energy along the structure. Thus, in the present embodiments, the frequency bandwidth of the 180° hybrid structure is greatly expanded at frequencies below 3 GHz by optimizing the shape, size and position of the slotline open circuits 28 and 29 in the slotline-to-microstrip transition.

Figure 11:
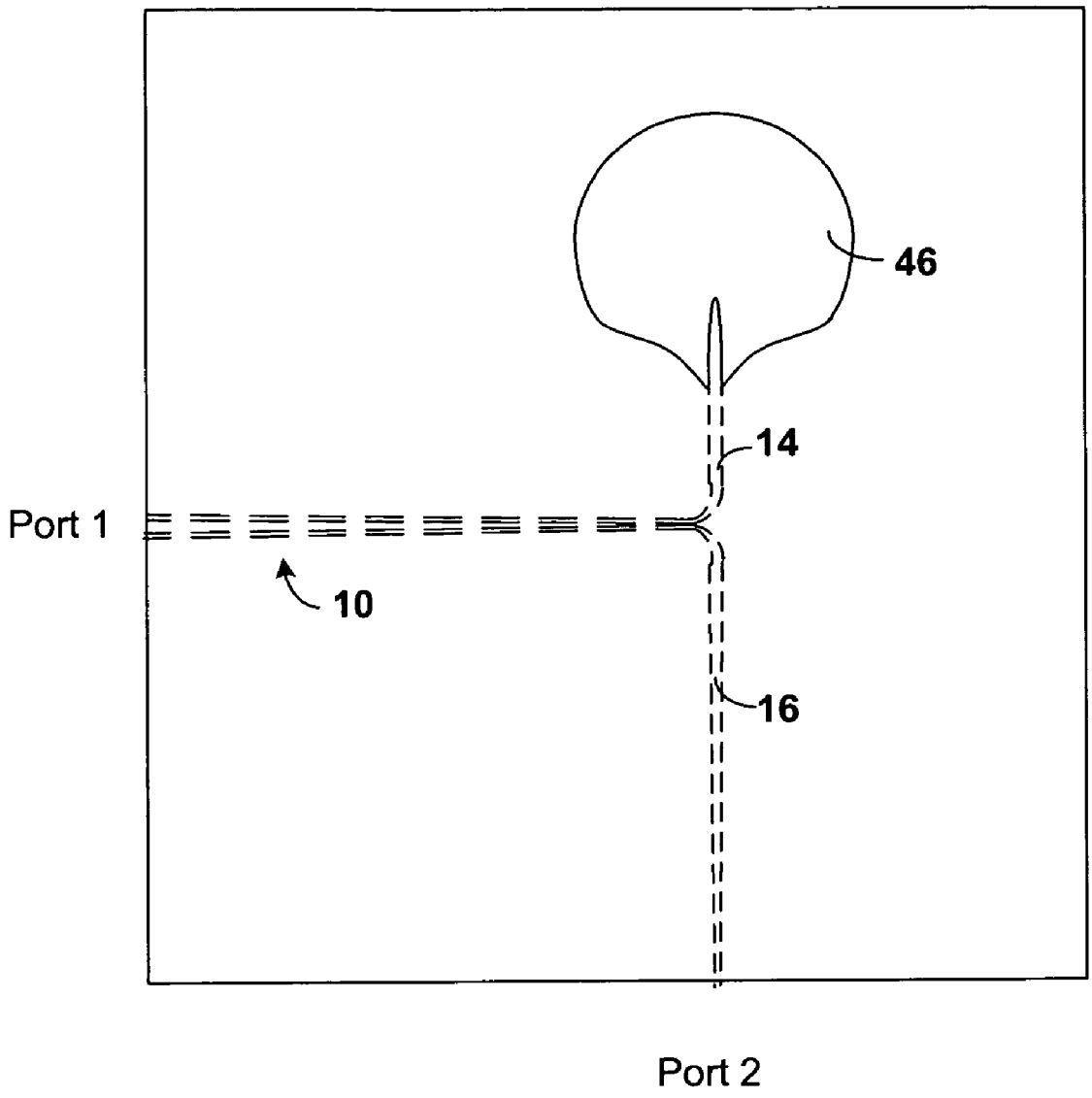
FIG. 11 shows an alternative embodiment for a 180° hybrid device according to the present invention.

FIG. 11 shows an alternate embodiment of a planar balun in accordance with the present invention. The illustrated embodiment is based on a unbalanced to balanced transformer utilized in a 180° hybrid similar to FIG. 2 with components similarly labeled. In FIG. 11 one of the slotlines 14 is terminated into tapered thin film resistive media. The resistive material is simply applied over the etched out metalization region. The resistive material value in ohms-per-square can be selected to meet design requirements. By doing so approximately 50% of the energy of input signal is absorbed by a resistor and another 50% of the input signal energy is coupled to balanced slotline 16. The characteristic impedance of slotline 16 can be adjusted to meet any particular design requirements. The gradual tapered impedance transformer shown can be used to meet the desired bandwidth requirements. The gradual taper introduced to the resistive termination in the illustrated coplanar to slotline greatly improves the bandwidth of this structure.

Although the present invention has been described above with particularity, this was merely to teach one of ordinary skill in the art how to make and use the invention. Many additional modifications will fall within the scope of the invention, as that scope is defined by the following claims.

What is claimed is:

1. A hybrid transmission device comprising:

a common port;

a coplanar waveguide connected on a first end to the common port;

a power divider having a first terminal connected to the coplanar waveguide, and having second and third terminals;

slotlines, each slotline connected on a first end to a respective one of the second and third terminals of the power divider;

terminations provided on the second ends of the slotlines, the terminations formed by openings formed in the metalization region at the second ends of the slotlines to create open circuits;

a first differential port;

a first microstrip line connected on a first end to the first differential port and connected on a second end by a first microstrip to slotline transition near a second end of a first of the slotlines;

a second differential port; and a second microstrip line connected on a first end to the second differential port and connected on a second end by a second microstrip to slotline transition near a second end of a second of the slotlines.

2. The hybrid transmission device of claim 1, wherein the coplanar waveguide is formed in a first metalization layer on a first side of a substrate, and wherein the microstrip lines comprise metal lines formed in a second metalization region on an opposing side of the substrate.

3. The hybrid transmission device of claim 1, wherein the slotlines are tapered.

4. The hybrid transmission device of claim 3, wherein the slotlines are tapered from a large width at the first end to a smaller width near the slotline to microstrip transitions.

5. The hybrid transmission device of claim 1, wherein the coplanar waveguide is tapered from a large width at the common port to a smaller width near the power divider.

6. The hybrid transmission device of claim 2, wherein near the second end of each of the slotlines, a portion of a loop is provided around the short circuit via connecting one of the microstrip lines to the first metalization layer.

7. The hybrid transmission device of claim 2, wherein the terminations on the slotlines comprise openings tapered from the slotline to a substantially greater width in the metalization layer.

8. The hybrid transmission device of claim 1, wherein magnetic material is provided over a part of the terminations.

9. The hybrid transmission device of claim 1, wherein the first microstrip to slotline transition is provided in a metalization region with a central conductor of the coplanar waveguide, and wherein the second microstrip to slotline transition is provided in a metalization region with an outer conductor of the coplanar waveguide.

10. The hybrid transmission device of claim 9, wherein a first one of the terminations is placed to substantially isolate the first microstrip line from the metalization region; and wherein a second one of the terminations is placed to substantially isolate the second microstrip line from the metalization region.

11. The hybrid transmission device of claim 1, wherein signals provided on the first differential port and the second differential port are approximately 180° out of phase.

12. A signal transmission device comprising:

a first port;

a coplanar waveguide connected on a first end to the first port;

a power divider having a first terminal connected to the coplanar waveguide, and having second and third terminals;

slotlines, each slotline connected on a first end to a respective one of the second and third terminals of the power divider;

a termination provided on the second end of a first one of the slotlines; and a second port connected to the second end of a second one of the slotlines.

13. The signal transmission device of claim 12, wherein the termination is formed by a resistive material applied over a portion of the first slotline.

14. The signal transmission device of claim 12, wherein the slotlines are tapered.

15. The signal transmission device of claim 12, wherein the coplanar waveguide is tapered.

16. The signal transmission device of claim 12, wherein signals provided on the first slotline and the second slotline are approximately 180° out of phase.

17. A 180° hybrid device comprising:

a common port;

a coplanar waveguide connected on a first end to the common port provided in a first metalization region of a substrate;

a power divider having a first terminal connected to the coplanar waveguide, and having second and third terminals, the power divider being provided in the first metalization region;

slotlines, each slotline connected on a first end to a respective one of the second and third terminals of the power divider, the slotlines being provided in the first metalization region;

slotline to microstrip transitions with slotline terminations provided on the second ends of the slotlines, the slotline terminations formed by openings formed in the first metalization region at the second ends of the slotlines to create open circuits, wherein a microstrip termination on a first of the slotlines is provided in a portion of the first metalization region in common with a central conductor of the coplanar waveguide, and wherein a second of the microstrip terminations is provided in the first metalization region with the outer conductor of the coplanar waveguide;

a first differential port;

a first microstrip line connected on a first end to the first differential port and connected on a second end by a first microstrip to slotline transition near a second end of a first of the slotlines;

a second differential port; and a second microstrip line connected on a first end to the second differential port and connected on a second end by a second microstrip to slotline transition near a second end of a second of the slotlines, wherein near the second end of each of the slotlines, a portion of a loop is provided around the short circuit via connecting one of the microstrip lines to the first metalization layer, and wherein the microstrip lines comprise metal lines formed in a second metalization region on an opposing side of the substrate to the first metalization region.

18. The hybrid transmission device of claim 17, wherein the coplanar waveguides are tapered, and wherein the slotlines are tapered.

* * * * *